US010141136B1

(12) United States Patent
Volpe

(10) Patent No.: US 10,141,136 B1
(45) Date of Patent: Nov. 27, 2018

(54) LIGHT SWITCH ACTUATOR

(71) Applicant: John Volpe, Newtown Square, PA (US)

(72) Inventor: John Volpe, Newtown Square, PA (US)

( * ) Notice: Subject to any disclaimer, the term of this patent is extended or adjusted under 35 U.S.C. 154(b) by 0 days.

(21) Appl. No.: 15/658,497

(22) Filed: Jul. 25, 2017

(51) Int. Cl.

| | |
|---|---|
| ***H01H 21/22*** | (2006.01) |
| ***H01H 21/04*** | (2006.01) |
| ***H01H 17/26*** | (2006.01) |
| ***H01H 17/28*** | (2006.01) |
| ***H01H 23/14*** | (2006.01) |

(52) U.S. Cl.
CPC ..... *H01H 21/22* (2013.01); *H01H 17/26* (2013.01); *H01H 17/28* (2013.01); *H01H 21/04* (2013.01); *H01H 23/141* (2013.01)

(58) Field of Classification Search
CPC ..... H01H 17/28; H01H 17/26; H01H 23/141; H01H 21/04; H01H 21/22
See application file for complete search history.

(56) References Cited

U.S. PATENT DOCUMENTS

| | | | | |
|---|---|---|---|---|
| 2,461,614 A | | 2/1949 | Seaman | |
| 2,466,820 A | | 4/1949 | Oberschmidt | |
| 2,760,035 A | * | 8/1956 | Friesen | H01H 23/141 200/331 |
| 3,175,420 A | * | 3/1965 | Craig | H01H 23/141 200/331 |
| 4,221,946 A | | 9/1980 | Halstrum | |
| 4,256,943 A | * | 3/1981 | Whitlock | H01H 23/141 200/331 |
| 4,562,325 A | | 12/1985 | Rouen | |
| 4,743,724 A | * | 5/1988 | Goodwin, Jr. | H01H 23/141 200/331 |
| 4,745,243 A | | 5/1988 | Wang | |
| D317,855 S | | 7/1991 | Miller | |
| 7,038,153 B2 | | 5/2006 | Zamecnik | |
| 9,406,464 B2 | | 8/2016 | Montano | |

FOREIGN PATENT DOCUMENTS

WO 2014066272 A1 5/2014

* cited by examiner

*Primary Examiner* — Felix O Figueroa
(74) *Attorney, Agent, or Firm* — Kyle A. Fletcher, Esq.

(57) ABSTRACT

The light switch actuator is a kit configured for use with a toggle switch and a wall plate. The light switch actuator attaches a plurality of cords to the toggle of the toggle switch such that the toggle switch can be actuated from a distance. The light switch actuator comprises a toggle attachment, a plurality of eyebolts, a plurality of cords, a plurality of tassels, the toggle switch and the wall plate. The toggle switch is installed in the selected location in the normal manner as required by the local electric code. The plurality of eyebolts attach the wall plate to the toggle switch. The toggle attachment attaches the plurality of cords to the toggle of the toggle switch. A tassel selected from the plurality of tassels is attached to the free end of a cord selected from the plurality of cords.

11 Claims, 3 Drawing Sheets

LIGHT SWITCH ACTUATOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of basic electric elements including electric switches, more specifically, a mechanism for operating the contacts of a switch.

SUMMARY OF INVENTION

The light switch actuator is a kit. The light switch actuator is configured for use with a toggle switch. The toggle switch is also commonly referred to as a wall switch. The toggle switch is a readily and commercially available product that is further defined with a toggle. The light switch actuator is configured for use with a wall plate. The wall plate is placed over the toggle switch to protect the user from electrical shock. The wall plate is a readily and commercially available product that is further defined with a first switch screw hole and a second switch screw hole. The first switch screw hole and second switch screw hole allow the wall plate to be attached to the toggle switch. The light switch actuator is configured for use with a toggle switch that is mounted in a location selected from the group consisting of a wall or a ceiling. The light switch actuator is intended for use on a light switch that is positioned in a difficult to reach location. The light switch actuator attaches a plurality of cords to the toggle of the toggle switch such that the toggle switch can be actuated from a distance that is beyond the reach of the person actuating the toggle switch. The light switch actuator may be used to complete or interrupt the circuit controlled by the toggle switch. The light switch actuator comprises a toggle attachment, a plurality of eyebolts, a plurality of cords, a plurality of tassels, the toggle switch and the wall plate. The toggle switch is installed in the selected location in the normal manner as required by the local electric code. The plurality of eyebolts attach the wall plate to the toggle switch. The toggle attachment attaches the plurality of cords to the toggle of the toggle switch. A tassel selected from the plurality of tassels is attached to the free end of a cord selected from the plurality of cords.

These together with additional objects, features and advantages of the light switch actuator will be readily apparent to those of ordinary skill in the art upon reading the following detailed description of the presently preferred, but nonetheless illustrative embodiments when taken in conjunction with the accompanying drawings.

In this respect, before explaining the current embodiments of the light switch actuator in detail, it is to be understood that the light switch actuator is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the light switch actuator.

It is therefore important that the claims be regarded as including such equivalent construction insofar as they do not depart from the spirit and scope of the light switch actuator. It is also to be understood that the phraseology and terminology employed herein are for purposes of description and should not be regarded as limiting.

BRIEF DESCRIPTION OF DRAWINGS

The accompanying drawings, which are included to provide a further understanding of the invention, are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
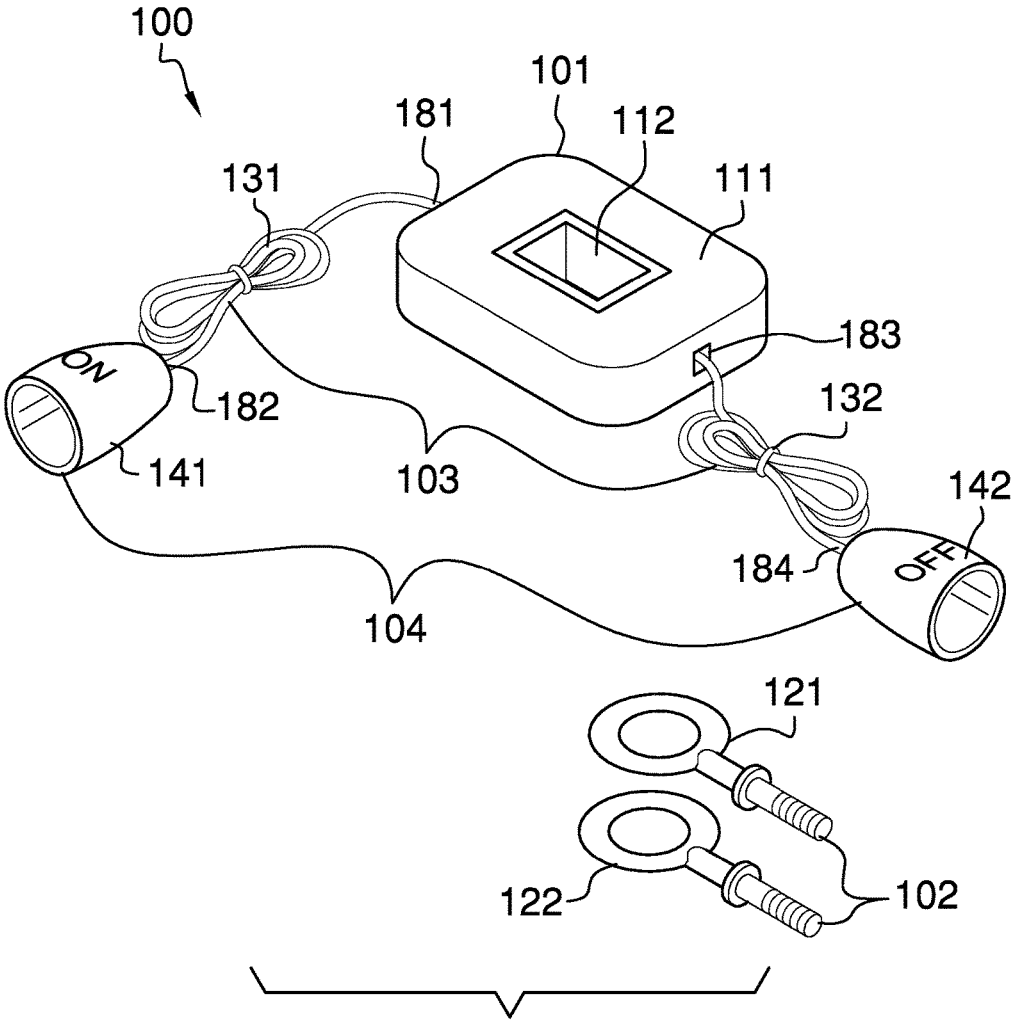
FIG. 1 is a perspective view of an embodiment of the disclosure.
Figure 2:
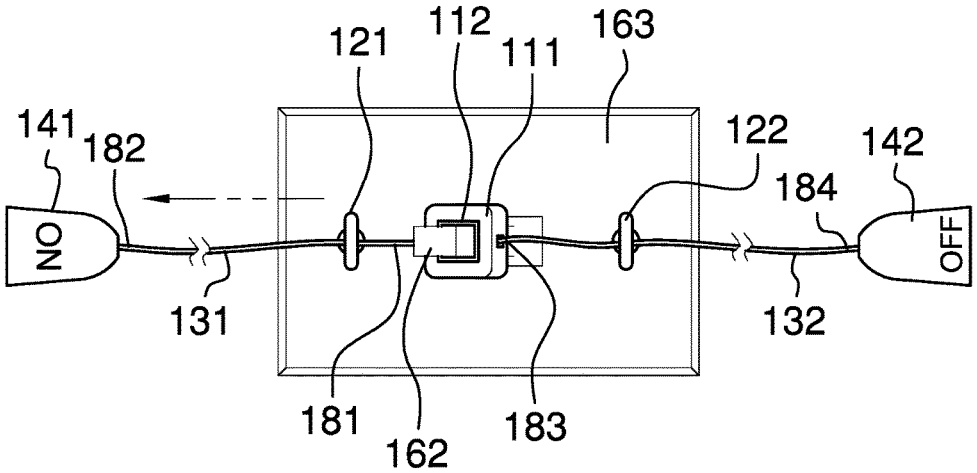
FIG. 2 is a detail view of an embodiment of the disclosure.
Figure 3:
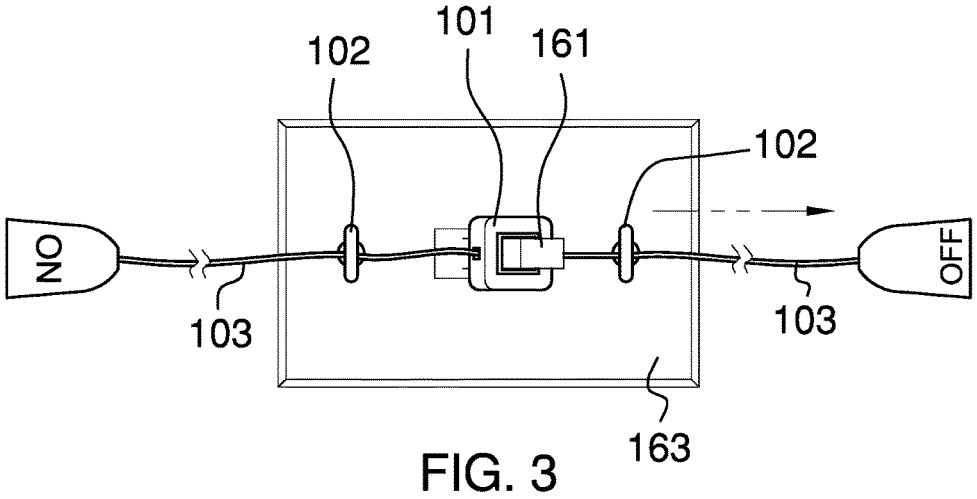
FIG. 3 is a detail view of an embodiment of the disclosure.
Figure 4:
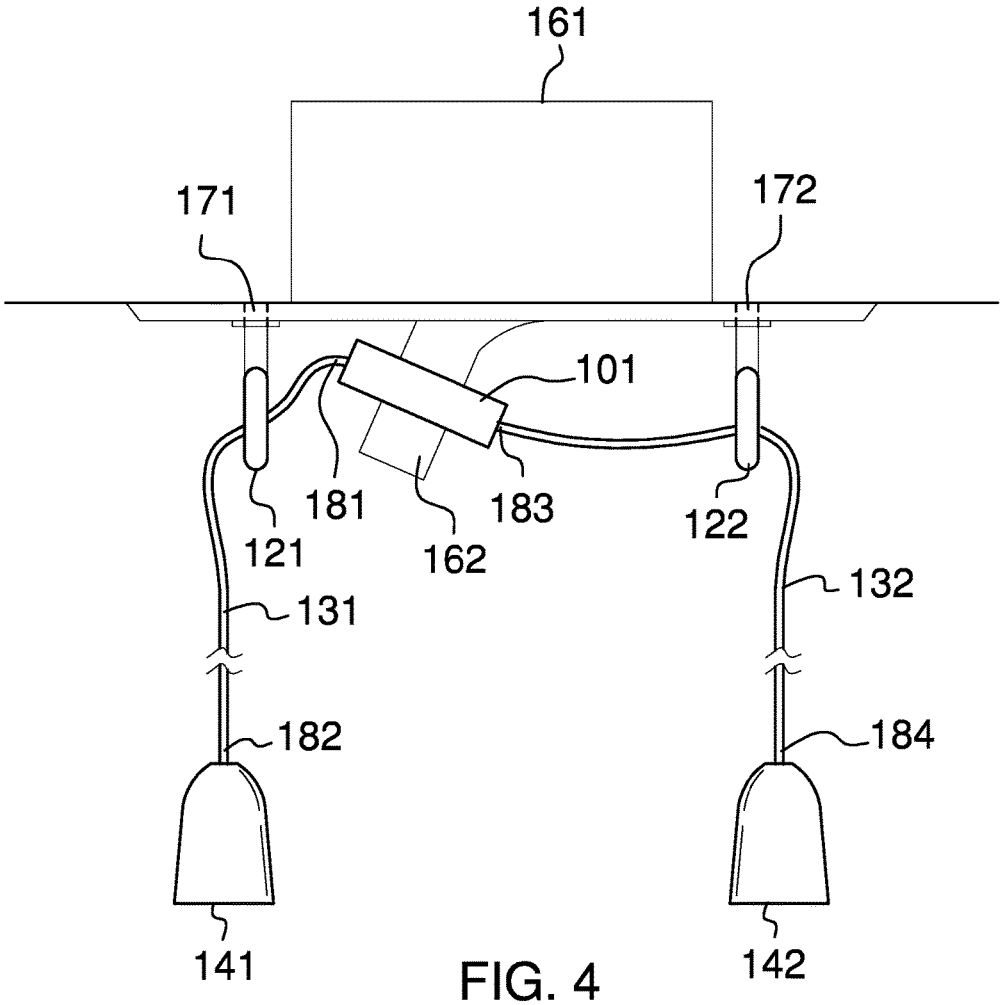
FIG. 4 is a side view of an embodiment of the disclosure.

Detailed reference will now be made to one or more potential embodiments of the disclosure, which are illustrated in FIGS. 1 through 4.

The light switch actuator 100 (hereinafter invention) is a kit. The invention 100 is configured for use with a toggle 162 switch 161. The toggle 162 switch 161 is also commonly referred to as a wall switch. The toggle 162 switch 161 is a readily and commercially available product that is further defined with a toggle 162. The invention 100 is configured for use with a wall plate 163. The wall plate 163 is placed over the toggle 162 switch 161 to protect the user from electrical shock. The wall plate 163 is a readily and commercially available product that is further defined with a first switch screw hole 171 and a second switch screw hole 172. The first switch screw hole 171 and second switch screw hole 172 allow the wall plate 163 to be attached to the toggle 162 switch 161. The invention 100 is configured for use with a toggle 162 switch 161 that is mounted in a location selected from the group consisting of a wall or a ceiling.

The invention 100 is intended for use as a light switch that is positioned in a difficult to reach location. The invention 100 attaches a plurality of cords 103 to the toggle 162 of the toggle 162 switch 161 such that the toggle 162 switch 161 can be actuated from a distance that is beyond the reach of the person actuating the toggle 162 switch 161. The invention 100 may be used to both complete and interrupt the circuit controlled by the toggle 162 switch 161. The kit that forms the invention 100 formally comprises a toggle 162 switch 161, a wall plate 163, a toggle 162 attachment 101, a plurality of eyebolts 102, a plurality of cords 103, and a plurality of tassels 104. The toggle 162 switch 161 is installed in the selected location in the normal manner as required by the local electric code. The plurality of eyebolts 102 attach the wall plate 163 to the toggle 162 switch 161. The toggle 162 attachment 101 attaches the plurality of cords 103 to the toggle 162 of the toggle 162 switch 161. A tassel selected from the plurality of tassels 104 is attached to the free end of a cord selected from the plurality of cords 103.

The toggle 162 switch 161 is a readily and commercially available toggle 162 switch 161. The toggle 162 switch 161 is often referred to as a wall switch. The toggle 162 switch 161 is further defined with a toggle 162. The toggle 162 is a lever that is associated with the toggle 162 switch 161. The toggle 162 is used to actuate the toggle 162 switch 161.

The wall plate 163 is a readily and commercially available hardware item that is used to cover the toggle 162 switch 161. The wall plate 163 prevents unauthorized access to the electrical connections of the toggle 162 switch 161. The wall plate 163 is further defined with a first switch screw hole 171 and a second switch screw hole 172.

The first switch screw hole 171 is a hole that is formed through the wall plate 163. The location and the position of the first switch screw hole 171 is standardized. A first bolt is inserted through the first switch screw hole 171 and screwed into the toggle 162 switch 161 to attach the wall plate 163 to the toggle 162 switch 161.

The second switch screw hole 172 is a hole that is formed through the wall plate 163. The location and the position of the second switch screw hole 172 is standardized within the United States. A second bolt is inserted through the second switch screw hole 172 and screwed into the toggle 162 switch 161 to attach the wall plate 163 to the toggle 162 switch 161.

The toggle 162 attachment 101 is a structure that attaches to the toggle 162 of the toggle 162 switch 161. The toggle 162 attachment 101 is formed from an elastomeric material. The elastomeric material is deformed as the toggle 162 attachment 101 is attached to the toggle 162. As the toggle 162 attachment 101 returns to its relaxed shape the toggle 162 attachment 101 applies a pressure to the toggle 162 such that the toggle 162 attachment 101 is securely attached to the toggle 162.

In the first potential embodiment of the disclosure, the toggle 162 attachment 101 comprises an elastic ring 111. The elastic ring 111 further comprises a ring aperture 112. The elastic ring 111 is a ring shaped structure that is formed from an elastomeric material. The ring aperture 112 refers to the aperture that is formed through the elastic ring 111.

To attach the toggle 162 attachment 101 to the toggle 162 switch 161 the ring aperture 112 formed within the elastic ring 111 is placed over the toggle 162 of the toggle 162 switch 161. The ring aperture 112 is sized such that the ring aperture 112 must be deformed in order to fit over the toggle 162 of the toggle 162 switch 161. As the elastic ring 111 returns to its relaxed shape the ring aperture 112 applies a force to the toggle 162 that secures the toggle 162 attachment 101 to the toggle 162 of the toggle 162 switch 161.

The plurality of eyebolts 102 are used to attach the wall plate 163 to the toggle 162 switch 161. Each of the plurality of eyebolts 102 is a commercially available eyebolt. Each of the plurality of eyebolts 102 is further formed with an exterior screw thread. Any eyebolt selected from the plurality of eyebolts 102 is sized such that the selected eyebolt can be inserted through a screw hole selected from the group consisting of the first switch screw hole 171 of the wall plate 163 and the second switch screw hole 172 of the wall plate 163. Any eyebolt selected from the plurality of eyebolts 102 is sized such that the selected eyebolt can be screwed directly into a standardized interior screw thread provided with any commercially available toggle 162 switch 161. The plurality of eyebolts 102 comprises a first eyebolt 121 and a second eyebolt 122.

In the first potential embodiment of the disclosure, the first eyebolt 121 is sized such that the first eyebolt 121 can be inserted through the first switch screw hole 171 and used as a direct replacement for the first bolt. The second eyebolt 122 is sized such that the second eyebolt 122 can be inserted through the second switch screw hole 172 and used as a direct replacement for the second bolt. The first eyebolt 121 is a readily and commercially available eyebolt. The second eyebolt 122 is a readily and commercially available eyebolt.

Each of the plurality of cords 103 is a commercially available cord. An end of each of the plurality of cords 103 attaches to the toggle 162 attachment 101. The plurality of cords 103 are arranged such that pulling on a cord selected from the plurality of cords 103 will actuate the toggle 162 switch 161. The plurality of cords 103 comprises a first cord 131 and a second cord 132. The first cord 131 is further defined with a first end 181 and a second end 182. The second cord 132 is further defined with a third end 183 and a fourth end 184.

The first cord 131 is a readily and commercially available cord. The first cord 131 is sized such that the first cord 131 can be inserted through the eyelet of an eyebolt selected from the plurality of eyebolts 102. The second cord 132 is a readily and commercially available cord. The second cord 132 is sized such that the second cord 132 can be inserted through the eyelet of an eyebolt selected from the plurality of eyebolts 102.

The first cord 131 inserts through the eyelet of the first eyebolt 121. The second cord 132 inserts through the eyelet of the second eyebolt 122. The eyelet of the first eyebolt 121 adjusts the direction of the first cord 131 such that the first cord 131 can be pulled to actuate the toggle 162 of the toggle 162 switch 161 in a first direction. The eyelet of the second eyebolt 122 adjusts the direction of the second cord 132 such that the second cord 132 can be pulled to actuate the toggle 162 of the toggle 162 switch 161 in a second direction that is opposite to the first direction.

With this arrangement the first cord 131 will actuate the toggle 162 in a manner selected from the group consisting of completing an electric circuit controlled by the toggle 162 switch 161 or interrupting the electric circuit controlled by the toggle 162 switch 161.

The second cord 132 will actuate the toggle 162 in a manner such that: 1) the manner is selected from the group consisting of completing an electric circuit controlled by the toggle 162 switch 161 or interrupting the electric circuit controlled by the toggle 162 switch 161; and, 2) the manner selected for the second cord 132 is different from the manner selected for the first cord 131.

The first end 181 of the first cord 131 attaches to the elastic ring 111. The second end 182 of the first cord 131 is inserted through the eyelet of the first eyebolt 121. The third end 183 of the second cord 132 attaches to the elastic ring 111. The fourth end 184 of the second cord 132 is inserted through the eyelet of the second eyebolt 122.

Each of the plurality of tassels 104 is a commercially available tassel. Each of the plurality of tassels 104 is attached to the free end of a cord selected from the plurality of cords 103. Each tassel selected from the plurality of tassels 104 forms a grip that allows the cord associated with the selected tassel to be readily manipulated. Methods to attach tassels to cords are well known in the decorative arts. The plurality of tassels 104 comprises a first tassel 141 and a second tassel 142.

The first tassel 141 is a readily and commercially available tassel that attaches to first cord 131. The second tassel 142 is a readily and commercially available tassel that attaches to second cord 132. The first tassel 141 attaches to the second end 182 of the first cord 131. The second tassel 142 attaches to the fourth end 184 of the second cord 132.

The following definitions were used in this disclosure:

Bolt: As used in this disclosure, a bolt is a cylindrical shaft that is formed with an exterior screw thread. A bolt is defined with an outer diameter.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Elastic: As used in this disclosure, an elastic is a material or object that deforms when a force is applied to it and that is able to return to its relaxed shape after the force is removed. A material that exhibits these qualities is also referred to as an elastomeric material.

Eyebolt: As used in this disclosure, an eyebolt is a bolt that is formed with a ring at one end. The ring is commonly referred to as an eyelet.

Grip: As used in this disclosure, a grip is an accommodation formed within an object that allows the object to be grasped or manipulated by a hand.

Ring: As used in this disclosure, a ring is term that is used to describe a flat or plate like structure through which an aperture is formed.

Screw: When used as a verb in this disclosure, to screw means: 1) to fasten or unfasten (unscrew) a threaded connection; or 2) to attach a helical structure to a solid structure.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mechanism for operating an electric switch comprising:

a toggle switch, a wall plate, a toggle attachment, a plurality of eyebolts, and a plurality of cords;

wherein the plurality of eyebolts attach to the wall plate;

wherein the toggle attachment attaches the plurality of cords to a toggle of the toggle switch;

wherein the mechanism for operating the electric switch is a kit;

wherein the toggle switch is further defined with a toggle;

wherein the toggle switch is further defined with one or more interior screw threads;

wherein the wall plate is placed over the toggle switch;

wherein the wall plate is further defined with a first switch screw hole and a second switch screw hole;

wherein the toggle actuates the toggle switch;

wherein the first switch screw hole and second switch screw hole allow the wall plate to be attached to the toggle switch;

wherein the first switch screw hole is a hole that is formed through the wall plate;

wherein the second switch screw hole is a hole that is formed through the wall plate;

wherein the toggle attachment is formed from an elastomeric material;

wherein the elastomeric material is deformed as the toggle attachment is attached to the toggle;

wherein any eyebolt selected from the plurality of eyebolts is sized such that the selected eyebolt can be inserted through a screw hole selected from the group consisting of the first switch screw hole of the wall plate and the second switch screw hole of the wall plate;

wherein any eyebolt selected from the plurality of eyebolts is sized such that the selected eyebolt can be screwed directly into an interior screw thread selected from the one or more interior screw threads;

wherein each of the plurality of cords is a cord;

wherein an end of each of the plurality of cords attaches to the toggle attachment;

wherein the plurality of cords are arranged such that pulling on a cord selected form the plurality of cords will actuate the toggle switch;

wherein the toggle attachment comprises an elastic ring;

wherein the elastic ring is a ring shaped structure;

wherein the elastic ring further comprises a ring aperture;

wherein the elastic ring is formed from an elastomeric material;

wherein the ring aperture is placed over the toggle of the toggle switch;

wherein the ring aperture is sized such that the ring aperture must be deformed in order to fit over the toggle of the toggle switch;

wherein as the elastic ring returns to its relaxed shape the ring aperture applies a force to the toggle;

wherein the plurality of eyebolts attach the wall plate to the toggle switch;

wherein each of the plurality of eyebolts is an eyebolt;

wherein each of the plurality of eyebolts is further formed with an exterior screw thread;

wherein the plurality of eyebolts comprises a first eyebolt and a second eyebolt;

wherein the first eyebolt attaches the wall plate to the toggle switch;

wherein the second eyebolt attaches the wall plate to the toggle switch;

wherein the first eyebolt is sized such that the first eyebolt inserts through the first switch screw hole;

wherein the first eyebolt is sized such that the first eyebolt screws into a first interior screw thread selected from the one or more interior screw threads;

wherein the second eyebolt is sized such that the second eyebolt inserts through the second switch screw hole;

wherein the second eyebolt is sized such that the second eyebolt screws into a second interior screw thread selected from the one or more interior screw threads.

2. The mechanism for operating an electric switch according to claim 1 wherein the plurality of cords comprises a first cord and a second cord;

wherein the first cord is further defined with a first end and a second end;

wherein the second cord is further defined with a third end and a fourth end;

wherein the first cord attaches to the toggle attachment;

wherein the second cord attaches to the toggle attachment.

3. The mechanism for operating an electric switch according to claim 2 wherein the first cord is sized such that the first cord the first cord inserts through the eyelet of the first eyebolt;

wherein the second cord is sized such that the second cord inserts through the eyelet of the second eyebolt.

4. The mechanism for operating an electric switch according to claim 3 wherein the eyelet of the first eyebolt adjusts the direction of the first cord such that the first cord actuates the toggle of the toggle switch in a first direction;

wherein the eyelet of the second eyebolt adjusts the direction of the second cord such that the second cord actuates the toggle of the toggle switch in a second direction;

wherein the second direction is opposite to the first direction.

5. The mechanism for operating an electric switch according to claim 4 wherein the first cord will actuate the toggle in a manner selected from the group consisting of completing an electric circuit controlled by the toggle switch or interrupting the electric circuit controlled by the toggle switch.

6. The mechanism for operating an electric switch according to claim 5 wherein the second cord will actuate the toggle in a manner selected from the group consisting of completing an electric circuit controlled by the toggle switch or interrupting the electric circuit controlled by the toggle switch.

7. The mechanism for operating an electric switch according to claim 6 wherein the actuation manner selected for the second cord is different from the actuation manner selected for the first cord.

8. The mechanism for operating an electric switch according to claim 7 wherein the first end of the first cord attaches to the elastic ring;

wherein the second end of the first cord is inserted through the eyelet of the first eyebolt;

wherein the third end of the second cord attaches to the elastic ring;

wherein the fourth end of the second cord is inserted through the eyelet of the second eyebolt.

9. The mechanism for operating an electric switch according to claim 8 wherein mechanism for operating an electric switch further comprises a plurality of tassels;

wherein a tassel selected from the plurality of tassels is attached to a cord selected from the plurality of cords.

10. The mechanism for operating an electric switch according to claim 9 wherein each tassel selected from the plurality of tassels forms a grip.

11. The mechanism for operating an electric switch according to claim 10 wherein the plurality of tassels comprises a first tassel and a second tassel;

wherein the first tassel attaches to the second end of the first cord;

wherein the second tassel attaches to the fourth end of the second cord.

* * * * *